US005765407A

United States Patent [19]

Choo et al.

[11] Patent Number: 5,765,407

[45] Date of Patent: Jun. 16, 1998

[54] SELF-CONTAINED PORTABLE DEVICE FOR REMOVING STAINS

[75] Inventors: Tat Yin Choo; John A. MacNeill, both of Hudson, N.H.

[73] Assignee: Dasaver, Inc., Hudson, N.H.

[21] Appl. No.: 711,167

[22] Filed: Sep. 9, 1996

[51] Int. Cl.[6] ..... D06B 19/00

[52] U.S. Cl. ..... 68/214; 15/104.94; 15/118; 68/213; 206/229; 401/18; 510/277; 510/406; 510/439

[58] Field of Search ..... 68/213, 214; 15/104.94, 15/118; 401/18, 23; 510/277, 406, 439; 206/229

[56] References Cited

U.S. PATENT DOCUMENTS

| | | | |
|---|---|---|---|
| 296,092 | 4/1884 | Weed | 15/118 |
| 336,612 | 2/1886 | Wittram | 401/23 |
| 2,810,216 | 10/1957 | Greeg | 68/213 X |
| 3,100,908 | 8/1963 | Engle | 15/574 |
| 3,556,667 | 1/1971 | Kaufman | 15/118 X |
| 4,504,407 | 3/1985 | Klutz, Jr. et al. | 510/277 X |
| 4,557,618 | 12/1985 | Iwata et al. | 401/23 X |
| 4,721,403 | 1/1988 | Zinnbauer | 401/82 |
| 4,726,700 | 2/1988 | Gray | 401/183 |
| 4,889,441 | 12/1989 | Tice | 401/131 |
| 4,902,155 | 2/1990 | Buschemeyer | 401/206 |
| 4,936,700 | 6/1990 | Morris | 401/196 |
| 5,051,016 | 9/1991 | Bengston | 401/213 |
| 5,122,158 | 6/1992 | Kuroda et al. | 15/104.94 X |
| 5,148,572 | 9/1992 | Wells et al. | 15/104.94 X |
| 5,230,579 | 7/1993 | Klawson et al. | 401/205 |
| 5,548,859 | 8/1996 | Oberg et al. | 68/213 X |

*Primary Examiner*—Philip R. Coe

*Attorney, Agent, or Firm*—Jacob N. Erlich; Jerry Cohen; Edwin H. Paul

[57] ABSTRACT

A device and method for respectively providing and using a small, portable, discreet, yet complete on-the-spot stain remover unit. The unit can be activated on-the-spot to remove accidentally spilled food or beverage stains by removing the appropriate modules or body portions to achieve the desired cleaning steps. The stain removing or cleaning unit has a main applicator body, two sub-applicator bodies and two end covers. The modules, when connected together, make up the complete cleaning kit. The unit is designed to enable a user to perform four basic steps for cleaning a stain the instant it occurs, i.e., detergent soak, soiled detergent pickup, rinse and final drying.

19 Claims, 5 Drawing Sheets

SELF-CONTAINED PORTABLE DEVICE FOR REMOVING STAINS

FIELD OF THE INVENTION

The present invention relates generally to the removal of stains, and, more particularly, to a method and self-contained device for easily removing stains in variety of situations.

BACKGROUND OF THE INVENTION

Presenting a neat and professional looking appearance is a requirement for individuals in many walks of life and especially for persons involved with sales and marketing or white collar professionals that have to deal with the public or customers. It is not always easy to maintain a clean, neat appearance in the days of eating and drinking on the run, or having food and drink in a cramped airline seat, while traveling to an account for an important presentation. An accidentally soiled shirt or blouse could conceivably be an embarrassment and a good reason for ruining one's day. Hence, there exists the need for an easily accessible portable, self contained and complete cleaner kit to remove the soil from accidentally stained clothing.

The key to the successful removal of a food stain from clothing is to remove the stain before it has dried or has a chance to be embedded into the cloth fibers. The quicker one can clean the stained area, the better the outcome of the cleaning. On the spot and quick cleaning is not always available to the victims of food stain. By the time cleaning ingredients are available, the food stain has already dried and become deeply embedded into the fabrics and fibers of the clothing. Soap and water are usually not effective at that time. Partial and incomplete stain removal sometimes is worse than nonremoval. The stained area could even spread by using the wrong cleaner, or improper cleaning and rubbing. The use of the wrong soap or detergent could make the stain situation worse by spreading or adding rings to the stained area.

There have been attempts by suppliers of travel accessories to provide such a portable device. For example, there is available a portable cleaning product known as Stain Eraser™ which utilizes a small marker-sized cleaner tube with a felt tip. This product does not fully address the problem of on the spot cleaning requirements. This product is designed to be used as a handy source of solvent detergent in cleaning greasy stains from clothing. To use the product, the directions call for the removal of the clothing and to find a water source for rinsing along with a means to dry the wetted spots. This solution to the problem is no better than having someone carrying a small bottle of laundry detergent with them and use it when needed.

Another attempt to address the stain problem is found in a product that is called "Janie" Dry Spot Cleaner that comes in a kit form that uses absorbing clay-like powder to soak up the stain. The kit provides a small brush for brushing off the excess powder. The reflective nature of the powder helps mask some of the color of the stain. This method does not remove the imbedded stain other than masking the problem. Under the correct light and reflective condition, the stain is still clearly visible.

Another attempt at solving the staining problem would be to avoid the stain altogether by, for example, using a bib-like product called "bigBIB™". Clearly this is an inadequate solution to the problem, however, it does emphasize the serious nature of accidentally staining ones clothing.

It is therefore an object of this invention to provide a self-contained cleaner kit to be used to quickly and effectively remove stains.

It is another object of this invention to provide a cleaner kit which is portable.

It is still another object of this invention to provide a cleaner kit which is compact in size and readily stored in an individuals pocket, purse or briefcase.

It is a further object of this invention to provide a method for effectively removing stains from objects, even from clothes which are being worn.

SUMMARY OF THE INVENTION

The present invention overcomes the problems encountered in the past by providing a self-contained cleaning device made up of four main components: two sub-applicator bodies, a main body and covers. The sub-applicator bodies preferably contain a sponge soaked with cleaning agent, a rinsing sponge and a pair of drying sponges. The sub-applicator bodies are housed within the main body and the end caps seal the unit in a compact, yet readily usable fashion.

The cleaning kit or device of this invention can be easily stored in a shirt pocket, briefcase, glove compartment, desk drawer or pocketbook. When immediate stain removal is needed, it can be immediately activated and applied to a stained area with the following proper cleaning sequences, i.e., (1) immediate wetting and soaking of the stained area with cleaning liquid to loosen the stain; (2) pick up of excess cleaning liquid and loosed soil with a dry sponge; (3) wetting and rinsing the cleaned area with water or rinsing agent; and (4) soaking up the rinsed water residue with a second dry sponge.

The present invention by providing an effective, immediate cleaning device and method that includes a portable, self-contained cleaning unit wherein cleaning of a stain is effected by a minimum of a four-step process solves the long-felt problems associated with the swift cleaning of stains.

For a better understanding of the present invention, together with other and further objects, reference is made to the following description taken in conjunction with the accompanying drawings, and its scope will be pointed out in the appended claims.

DETAILED DESCRIPTION OF THE PREFERRED EMBODIMENTS

Figure 1:
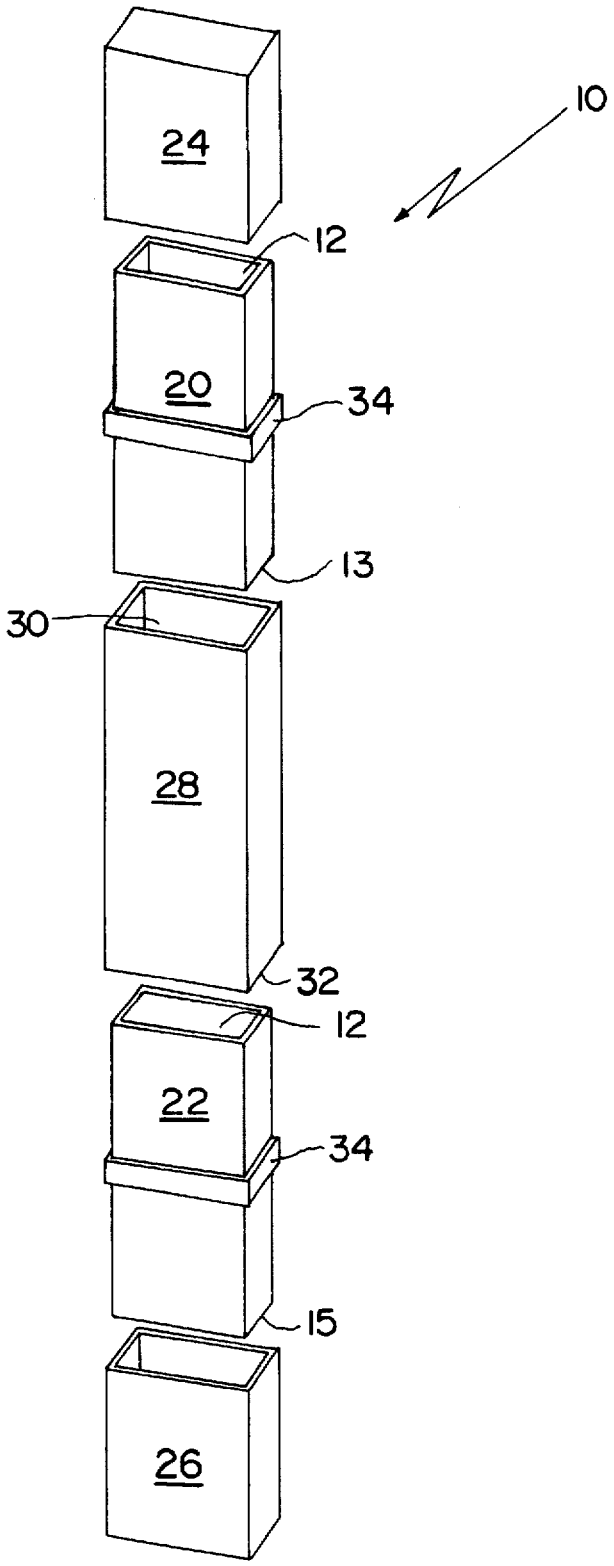
FIG. 1 is an exploded pictorial view of the self-contained portable stain removing device of this invention.

The complete design of the self-contained stain remover kit or device 10 is shown in FIG. 1 of the drawings with the internal cavities 12, 13 and 15 shown vacant while FIGS. 2A–2E (also referred to as FIG. 2) show the individual components of stain remover device 10 with cleaning sponge 14, rinsing sponge 16 and drying sponges 18 inserted. Still referring to FIGS. 1 and 2 of the drawings the kit or device 10 is made up of two similarly built sub-applicator bodies 20 and 22, two similarly built end covers 24 and 26 and a main applicator body 28. The main applicator body 28 is preferably made of a somewhat elongated rectangular configuration having a double cavity construction at each end 30 and 32 although other shapes such as cylindrical would also be acceptable. Body 28 functions as a double-cover for one of the ends of each of the sub-applicator bodies 20 and 22, respectively. As noted above the other end of each of the sub-applicator bodies 20 and 22 is covered by a respective end cover 24 and 26. Each of the sub-applicator bodies 20 and 22 also has a double reservoir cavity(well) construction. In addition, any suitable stop in the form of, for example, a lip 34 circumscribes each body 20 and 22 to limit the amount of insertion of bodies 20 and 22 into main applicator body 28.

An absorbent component such as an oversized sponge 14 saturated with a suitable cleansing agent such as a cleaning detergent is inserted into the reservoir cavity 12 on the sub-applicator 20 at the end facing the end cover 24. Another absorbent component such as an oversized dry sponge 18 is inserted into the opposite reservoir cavity 13 of the sub-applicator body 20 on the side facing the main applicator body 28. An absorbent component such as an oversized sponge 16 saturated with water or other rinsing agent such as, for example, an alcohol based rinse is inserted into the cavity 15 of sub-applicator body 22 at the end facing the end cover 26. Another absorbent component such as an oversized dry sponge 18 is inserted into the opposite reservoir cavity 12 of the sub-applicator body 22 facing the main applicator body 28.

Figure 2A:
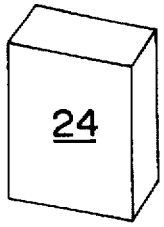
FIGS. 2A–2E are pictorial views of the components making up the self-contained portable stain removing device of this invention.
Figure 2B:
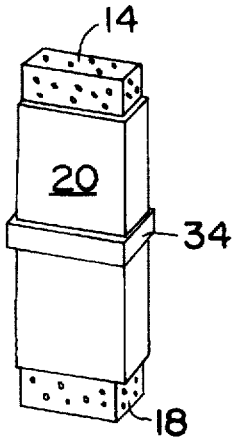
Figure 2C:
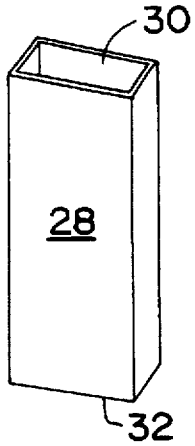
Figure 2D:
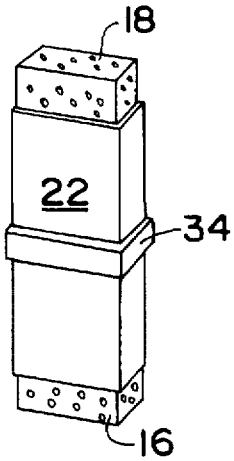
Figure 2E:
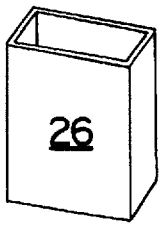

Each sponge is preferably in the form of an oversized opencell sponge pad that protrudes about ¼ to ½ of an inch beyond the edge of the respective applicator body 20 and 22, as shown in FIGS. 2B and 2D. The protruding saturated sponges 14 and 16 are designed to compress the balance of the sponge inside the cavity and to squeeze out the appropriate liquid when the sponges are pressed against a stain in a manner to be described in greater detail below. The protruding dry sponges 18 serve as an absorbing agent for the stain area. The end covers 24 and 26 complete the cleaning kit or device 10. This complete assembly or device 10, with all components shown separately is illustrated in FIG. 2. The same assembly or device 10, when snapped together and with all its covers in placed, is shown in FIG. 3.

Figure 3:
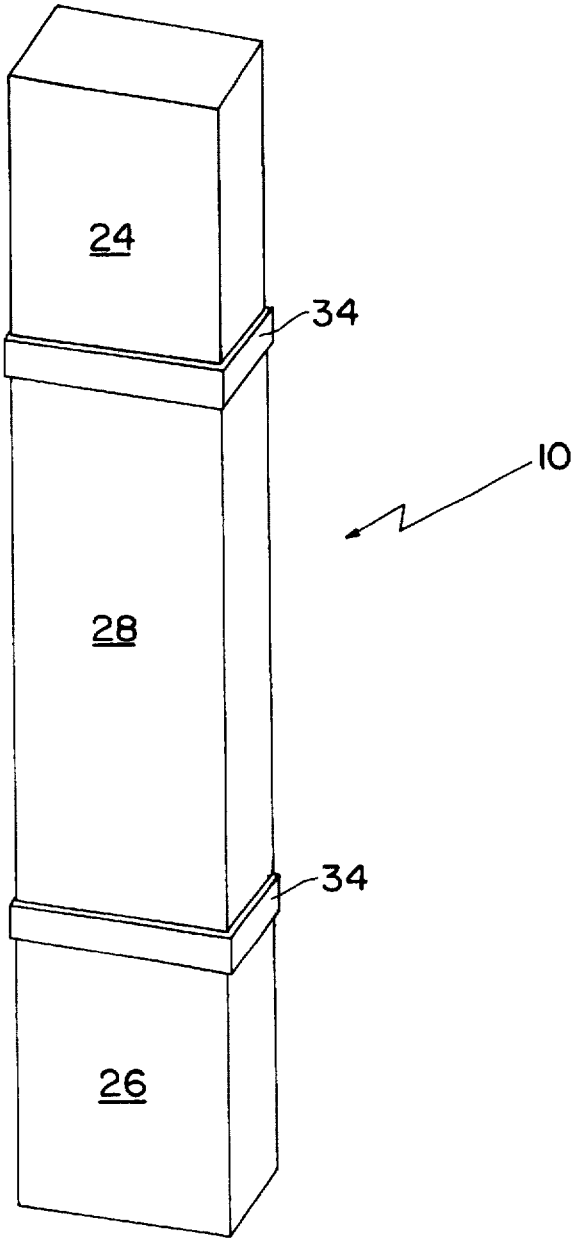
FIG. 3 is a pictorial view of the self-contained portable stain removing device of this invention.

Referring to FIGS. 1–3 of the drawings, the method of using the self-contained cleaning device 10 of this invention is now set forth. The user first removes the end cover 24 of sub-applicator body 20 to expose the detergent soaked sponge 14. The wetted cleaner sponge 14 can then be applied to a soiled area of a garment, for example, even while the garment is worn. With a light tabbing or rubbing in a circular manner and by varying the pressure applied against the stain area, one can control the amount of cleaner mixture released onto the soiled area as the saturated or soaked sponge 14 is compressed.

Rubbing the stained area lightly in a circular motion with the cleaner sponge 14 will wet the soiled area with the cleaner mixture or detergent which loosens and lifts the stain from a soiled fabric. Once the stain is loosened from the fabric or clothing, the user replaces the cover 24 by placing it back onto the sub-applicator body 20 to cover or hide the cleaner sponge 14.

The user then removes the sub-applicator body 20 together with its end cover 24 from the main applicator body 28 to expose the previously hidden or contained dry sponge 18. To absorb and remove any excess cleaner mixture with the loosened soil from the just cleaned area, one can dab and rub lightly on the just cleaned area with the dry sponge 18 to soak up excess cleaner and soils. After picking up the excess cleaner and soiled liquid with sponge 18, the user replaces the sub-applicator body 20, with end cover 24 in place, back into the main applicator body 28.

The user then rotates the stain remover kit or device 10 approximately 180 degrees and removes the end cover to expose the water soaked rinsing sponge 16 of sub-applicator body 22. To use the water soaked or saturated sponge 16 for rinsing, one would then rub the exposed sponge 16 onto the just cleaned and dried area and the sponge is pressed lightly to squeeze out a controlled amount of water or other rinsing agent to dilute the left over soiled detergent and to rinse the area. Additional water or rinsing agent can be directed to the area by pressing applicator body 28 against the area and compressing sponge 16.

After rinsing, the user replaces the end cover 26. One then removes the sub-applicator body 22, with its end cover 26 in place, from the main applicator body 28 to expose the dry sponge 18. The user then absorbs the excess water or rinsing agent by rubbing the rinsed area with the dry sponge 18. After cleaning, the unit or device 10 is reassembled by replacing the sub-applicator body 22, with its cover 26 in place, back into the main applicator body 28. The cleaning procedure is now complete.

This four-step cleaning process can also be modified within the scope of the present invention. Further, the design of the device and its application can also vary. For example, modified self-contained cleaner devices 30 and 50 of this invention and shown in FIGS. 4 and 5 of the drawings. Cleaner devices 30 and 50 illustrate the use of sponge rollers 32 in order to provide more surface area in place of the rigid sponge described above.

Figure 4:
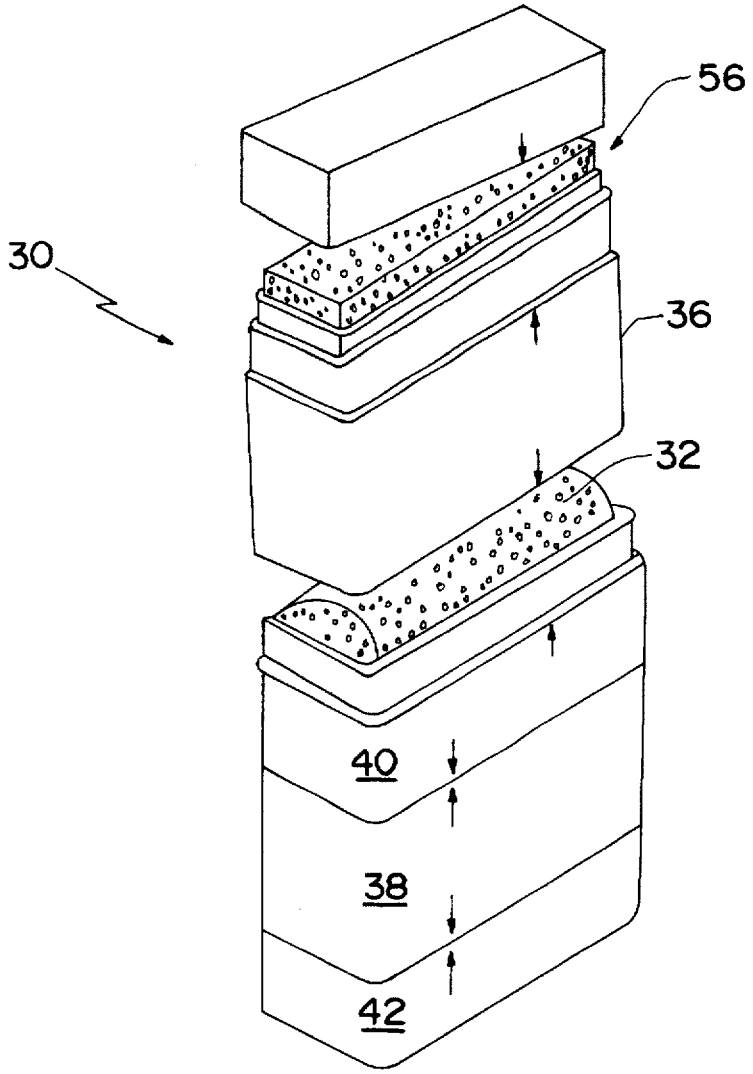
FIG. 4 is a pictorial view of a further embodiment of the present invention shown partially in exploded fashion.

The embodiment of FIG. 4 also shows the relocation of the drying sponges 32 from the sub-applicator bodies 36 and 38 to the main applicator body 40. In this embodiment of the invention the main applicator body 40, instead of being a double cavity cover as previously described in the embodiment of the invention shown in FIGS. 1–3, now acts as a double holder for the two roller dryer sponges 32 (only one of which being shown in FIG. 4).

Each of the sub-applicator bodies 36 and 38, respectively, shown in FIG. 4 of the drawings, perform two functions. One, it functions as a holder for the cleaning sponge 56 (and the rinsing sponge not shown) and two, as a cover for the roller sponge 32. The sub-applicator body 38, as shown at the bottom portion of FIG. 4, is in a closed position with the end cover 42 and main applicator body 40 in place.

It should be noted that the embodiment of this invention as shown in FIGS. 1–3 can also use roller dryer sponges in place of the protruding sponges 18. This embodiment will then have each of the sub-applicator bodies 20 and 22 with two types of sponges, protruding sponges 14 and 16 for cleaning or rinsing, and roller sponges for drying. Even further, all four sponges can be replaced by using roller sponges to offer more surface areas, if desired.

Figure 5:
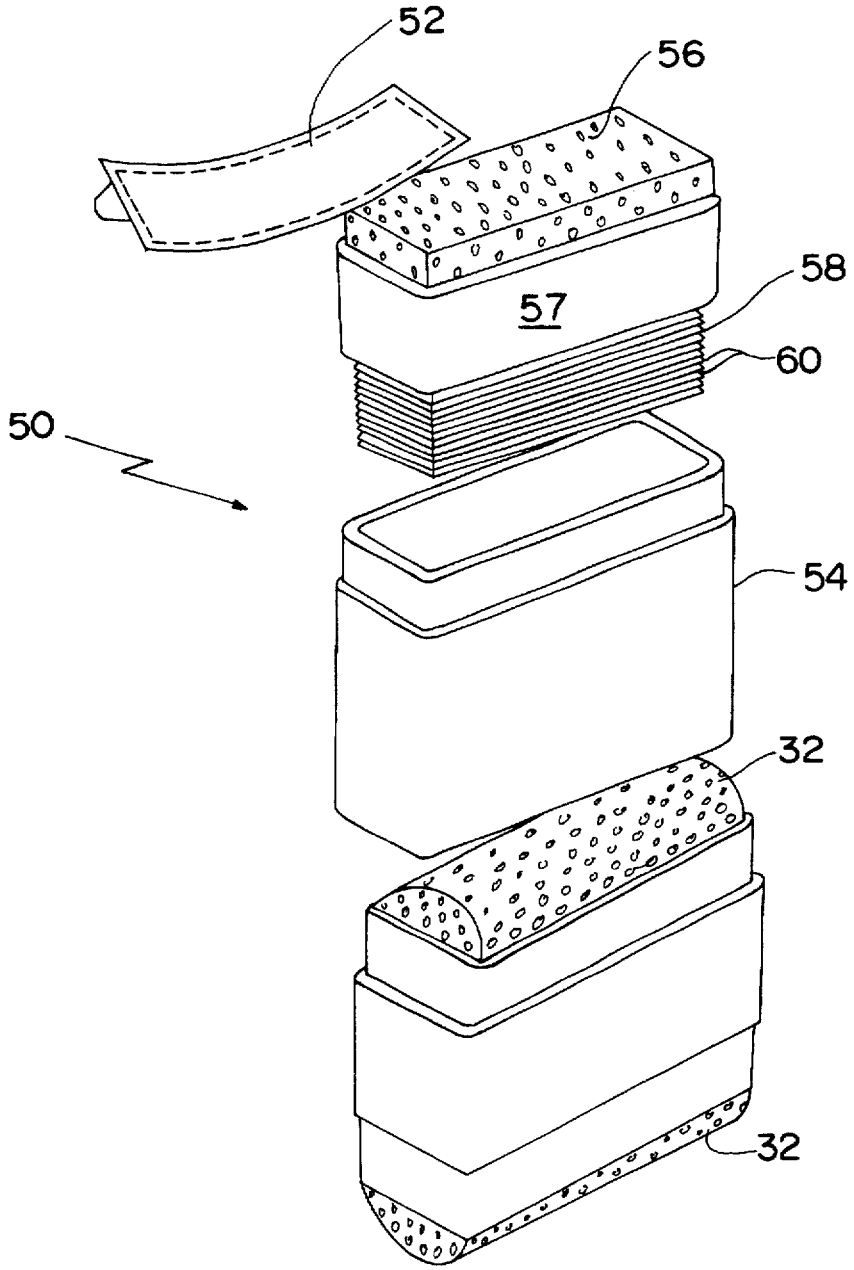
FIG. 5 is a pictorial view of a still further embodiment of the present invention shown in exploded fashion.

As shown in FIG. 5 of the drawings, the cleaning sponge and water sponge can be housed in its own water tight modules sealed with a foil tab 52 and then be inserted into the applicator body 54. This embodiment of the invention is shown in FIG. 5 with a protruding sponge 56 having the foil tab 52 removed. In this embodiment of the invention, the module 57 is designed with a collapsible base 58 having flexible ridges 60 at the bottom. The collapsible base 58 is designed for compression in order to force the detergent or water onto the stain area. This design, although slightly more complicated and expensive to manufacture than the embodiment shown in FIGS. 1–3 of the drawings permits the application of more detergent solution or water to the stained area. The modules 57 can also be easily replaced after use.

It should also be realized that the embodiments of the present invention can also use different absorbent materials for the open cell sponges such as paper, cotton, fabrics, felt, fibers, brushes, or other man-made materials such as Scotch Brite® which have the capability to provide the liquid storage, absorption and rubbing capability of an open-cell sponge.

Other inventive concepts include providing a cleaning unit having a package of four-sponges contained in four small sealed foil packages. It is also possible to provide a four-sponge package in differently designed applicator(s), container(s) or package(s) within the scope of this invention.

Another embodiment can incorporate the detergent mixture in a small bottle with an attached sponge applicator to clean the stain and another similar small bottle with water to soak. This process is then completed with separate drying sponges to pick up moisture from stain area. One can also repeat the cleaning process by providing a more than four step cleaning process including extra detergent soak, rinsing and drying steps and with a design or package to match. It should be realized that one can also carry spare sponges and bottles of detergent and water to reassemble the cleaning kit for immediate cleaning need.

Although the invention has been described with reference to particular embodiments, it will be understood that this invention is also capable of further and other embodiments within the spirit and scope of the appended claims. For example, one can also use carbonated water (water containing compressed carbon dioxide gas) to replace the rinse water used in the cleaning process described above to offer an extra cleaning action. A mild solute such as water soluble alcohol solution can also be used as a substitute for the water in the rinse and detergent portions of the cleaning process as described. The alcohol solution will have the added benefit of evaporating at a faster rate than water. Furthermore, for the on-the-spot stain removal of water fast fabrics such as silk or leather, a solvent-based cleaner is needed. However, due to the nature of the cleaning method of this invention, which takes place immediately and often directly to areas which come in contact with the skin of the stain victim, the use of solvent-based cleaner may be precluded for safety reasons.

What is claimed is:

1. A self-contained portable device for removing a stain from an object, said device comprising:

a first body portion having means for applying a first agent to said stain in order to aid in the removal of said stain;

means for removing a substantial amount of said first agent and said stain;

a second body portion having means for applying a second agent to the stain which remains after application of said first agent;

means for removing said second agent and the remainder of said stain; and a third body portion for at least partially removably housing said first and said second body portion;

whereby said device can be easily stored as well as transported from one location to another.

2. A self-contained portable device for removing a stain as defined in claim 1 wherein said means for applying said first agent to said stain comprises an absorbent material containing a stain loosening and removing substance.

3. A self-contained portable device for removing a stain as defined in claim 1 wherein said means for removing a substantial amount of said first agent and said stain, and said means for removing said second agent and the remainder of the stain each comprise an absorbent material.

4. A self-contained portable device for removing a stain as defined in claim 3 wherein said means for applying said first agent to said stain comprises an absorbent material containing a stain loosening and removing substance.

5. A self-contained portable device for removing a stain as defined in claim 4 wherein said second agent is a water soluble alcohol solution and said first agent is a cleaning detergent.

6. A self-contained portable device for removing a stain as defined in claim 4 further comprising a first and second end cap removably associated with said first and said second body portion, respectively.

7. A self-contained portable device for removing a stain as defined in claim 3 wherein said absorbent material comprises a roller sponge.

8. A self-contained portable device for removing a stain as defined in claim 3 wherein at least one of said absorbent material of said means for removing a substantial amount of said first agent and said stain and said means for removing said second agent and the remainder of the stain comprises a roller sponge.

9. A self-contained portable device for removing a stain as defined in claim 1 wherein said third body portion has openings at opposite ends thereof for removably receiving said first and said second body portions therein, respectively, and said first and said second body portions each having means associated therewith for limiting the degree to which said first and said second body portion fits within said openings in said third body portion.

10. A self-contained portable device for removing a stain as defined in claim 1 further comprising at least one foil end tab associated with said first and said second body portion, respectively.

11. A self-contained portable device for removing a stain from an object, said device comprising a plurality of modules, one of said modules comprising a cleaner soaked module, another of said modules comprising a drying module, another of said modules comprising a water soaked module, and still another of said modules comprising a drying module.

12. A self-contained portable device for removing a stain from an object, said device comprising:

a first body portion having means for applying a first agent to said stain in order to aid in the removal of said stain;

a second body portion having means for applying a second agent to the stain which remains after application of said first agent; and a third body portion for removably attaching said first and said second body portions thereto, said third body portion containing first means for removing a substantial amount of said first agent and said stain and second means for removing said second agent and the remainder of said stain;

whereby said device can be easily stored as well as transported from one location to another.

13. A self-contained portable device for removing a stain as defined in claim 12 wherein said first body portion further comprises means for dispensing said first agent therefrom.

14. A self-contained portable device for removing a stain as defined in claim 13 wherein said second body portion further comprises means for dispensing said second agent therefrom.

15. A self-contained portable device for removing a stain as defined in claim 14 wherein said dispensing means comprises a collapsible, flexible portion of said first and said second body portions.

16. A self-contained portable device for removing a stain as defined in claim 15 wherein said means for removing a substantial amount of said first agent and said stain, and said means for removing said second agent and the remainder of the stain each comprise an absorbent material.

17. A self-contained portable device for removing a stain as defined in claim 16 wherein said absorbent material comprises a roller sponge.

18. A self-contained portable device for removing a stain as defined in claim 13 wherein said dispensing means comprises a collapsible, flexible portion of said first body portion.

19. A self-contained portable device for removing a stain from an object as defined in claim 1 wherein said means for removing a substantial amount of said first agent and said stain is incorporated in said first body portion and said means for removing said second agent and the remainder of said stain is incorporated within said second body portion.

* * * * *